US011156959B1

(12) United States Patent
Komatsu et al.

(10) Patent No.: US 11,156,959 B1
(45) Date of Patent: Oct. 26, 2021

(54) IMAGE FORMING APPARATUS AND NON-TRANSITORY COMPUTER READABLE MEDIUM

(71) Applicant: FUJI XEROX CO., LTD., Tokyo (JP)

(72) Inventors: Hitoshi Komatsu, Kanagawa (JP); Akira Otsu, Kanagawa (JP); Takuma Suwa, Kanagawa (JP); Takashi Kawakami, Kanagawa (JP); Tatsuya Ichikawa, Kanagawa (JP); Kunihiko Hayashi, Kanagawa (JP); Yutaka Watanabe, Kanagawa (JP); Masae Takabayashi, Kanagawa (JP); Ryosuke Hironaka, Kanagawa (JP); Hiroshi Shiota, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/109,328

(22) Filed: Dec. 2, 2020

(30) Foreign Application Priority Data

Apr. 23, 2020 (JP) ..... JP2020-076790

(51) Int. Cl.
*G03G 21/20* (2006.01)
*G03G 15/00* (2006.01)

(52) U.S. Cl.
CPC ..... *G03G 21/203* (2013.01); *G03G 15/6529* (2013.01)

(58) Field of Classification Search
CPC ..... G03G 21/203
See application file for complete search history.

(56) References Cited

U.S. PATENT DOCUMENTS

| | | | | |
|---|---|---|---|---|
| 6,070,024 | A * | 5/2000 | Oono | G03G 15/1645 399/310 |
| 10,338,490 | B1 * | 7/2019 | Stafford | G03G 15/0189 |
| 2013/0121739 | A1 * | 5/2013 | Hatazaki | G03G 15/2021 399/341 |
| 2015/0061212 | A1 * | 3/2015 | Sugiyama | G03G 15/6502 271/110 |

FOREIGN PATENT DOCUMENTS

| | | | |
|---|---|---|---|
| JP | 2000-085993 | A | 3/2000 |
| JP | 2010-189181 | A | 9/2010 |

* cited by examiner

*Primary Examiner* — Sevan A Aydin
(74) *Attorney, Agent, or Firm* — Oliff PLC

(57) ABSTRACT

An image forming apparatus includes a memory and a processor configured to, when humidity detected by a humidity sensor is equal to or above a preset value with paper sheets stacked in a paper sheet holder being fed to an image forming unit, perform control to set a separation operation time used to separate in a separation operation a single paper sheet from multiple paper sheets stacked in the paper sheet holder to be longer than the separation operation time used when the detected humidity is lower than the preset value.

7 Claims, 8 Drawing Sheets

FIG. 5

| PAPER QUALITY | PAPER SHEET LENGTH [mm] / WEIGHT PER UNIT AREA [g/m$^2$] | 220 OR LESS | 220 – 300 | 300 – 400 |
|---|---|---|---|---|
| MATT COATED PAPER, COATED PAPER, OR THE LIKE | 488.0 OR SHORTER | 40 ppm | 30 ppm | 30 ppm |
| | 488.1 – 660.4 | 20 ppm | 15 ppm | 15 ppm |
| | 660.5 – 864.0 | 15 ppm | 10 ppm | 10 ppm |
| | 864.1 – 1200.0 | 10 ppm | 5 ppm | 5 ppm |
| PLAIN PAPER, OR THE LIKE | 488.0 OR SHORTER | 50 ppm | 40 ppm | 40 ppm |
| | 488.1 – 660.4 | 30 ppm | 20 ppm | 20 ppm |
| | 660.5 – 864.0 | 20 ppm | 15 ppm | 15 ppm |
| | 864.1 – 1200.0 | 20 ppm | 10 ppm | 10 ppm |

FIG. 6

| PAPER QUALITY | PAPER SHEET LENGTH [mm] \ WEIGHT PER UNIT AREA [g/m$^2$] | 220 OR LESS | 220 – 300 | 300 – 400 |
|---|---|---|---|---|
| MATT COATED PAPER, COATED PAPER, OR THE LIKE | 488.1 – 660.4 | 10 ppm | 5 ppm | 5 ppm |
| | 660.5 – 864.0 | 12 ppm | 7 ppm | 7 ppm |
| | 864.1 – 1200.0 | 7 ppm | 3 ppm | 3 ppm |

IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2020-076790 filed Apr. 23, 2020.

BACKGROUND

(i) Technical Field

The present disclosure relates to an image forming apparatus and a non-transitory computer readable medium.

(ii) Related Art

Japanese Unexamined Patent Application Publication No. 2000-085993 discloses a paper sheet feeder apparatus that improves productivity and reliability by lengthening sheet feeding time interval in response to the occurrence of overlapping sheet feed.

Japanese Unexamined Patent Application Publication No. 2010-189181 discloses a paper sheet feeder apparatus that performs air assist separation by using optimum heating time and temperature responsive to the type of paper sheets contained.

Image forming apparatuses perform image forming by holding multiple paper sheets on a paper sheet holder, such as a paper sheet tray, and by feeding a single sheet to an image forming unit through separating the single sheet from the other sheets. However, paper sheets may stick easily to each other under a high humidity condition and sheet feeding is more likely performed with multiple sheets overlapped on each other. In particular, when long paper sheets having a longer length, the possibility of the overlapping sheet feed is even higher.

SUMMARY

Aspects of non-limiting embodiments of the present disclosure relate to providing an image forming apparatus and a non-transitory computer readable medium lengthening a separation operation time to separate one sheet from other sheets stacked in a paper sheet holder under a higher humidity condition in comparison with the case in which sheet feeding is performed at constant feeding time intervals regardless of humidity.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a memory and a processor configured to, when humidity detected by a humidity sensor is equal to or above a preset value with paper sheets stacked in a paper sheet holder being fed to an image forming unit, perform control to set a separation operation time used to separate in a separation operation a single paper sheet from multiple paper sheets stacked in the paper sheet holder to be longer than the separation operation time used when the detected humidity is lower than the preset value.

BRIEF DESCRIPTION OF THE DRAWINGS

Exemplary embodiments of the present disclosure will be described in detail based on the following figures, wherein:

FIG. 5 illustrates an example of a serial print speed table in a normal environment;

FIG. 6 illustrates an example of a serial print speed table in a higher humidity environment;

DETAILED DESCRIPTION

Exemplary embodiments are described in detail with reference to the drawings.

Figure 1:
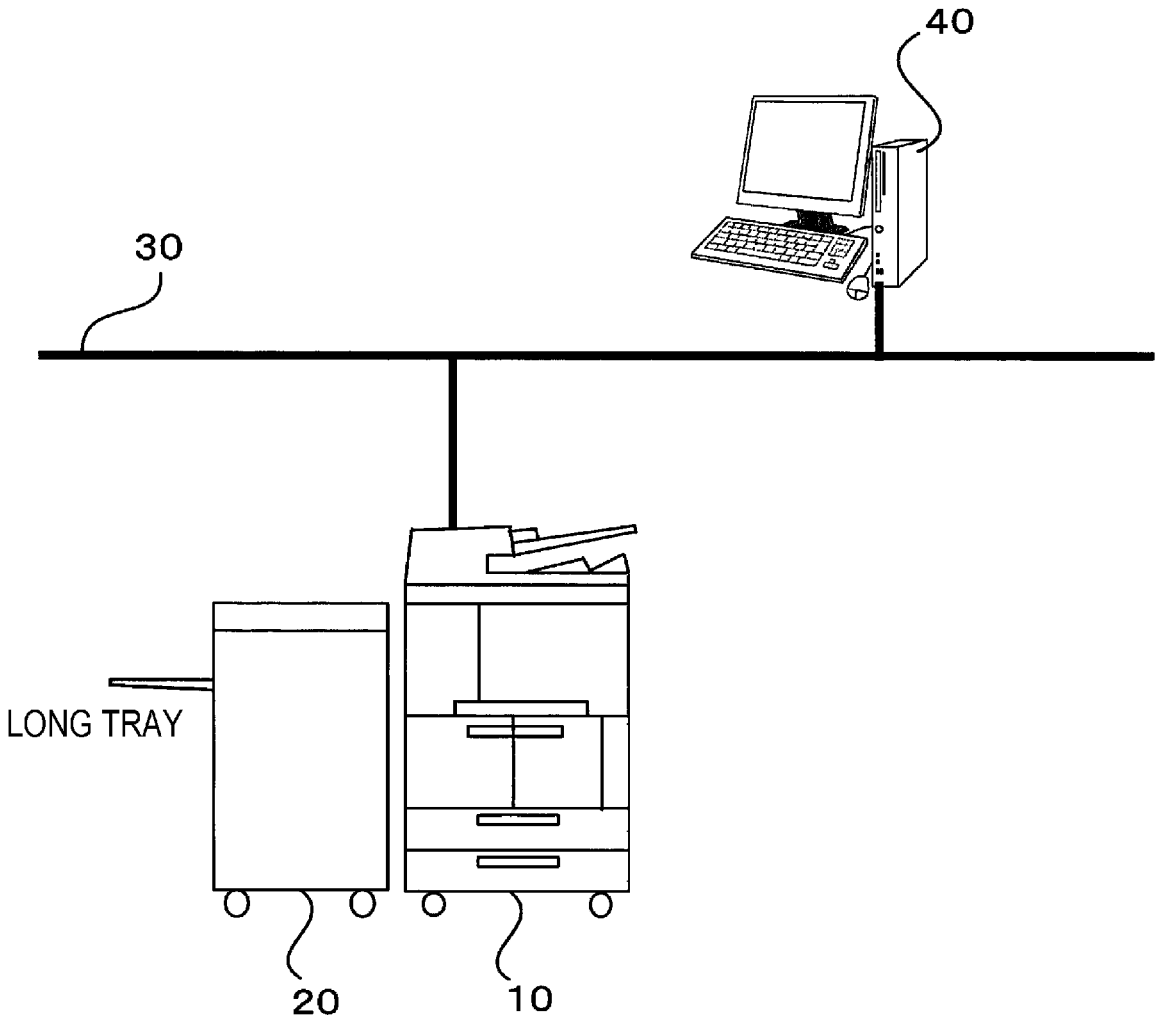
FIG. 1 illustrates a configuration of an image forming system of an exemplary embodiment of the present disclosure.

FIG. 1 illustrates an image forming system of an exemplary embodiment of the present disclosure.

The image forming system of the exemplary embodiment of the present disclosure includes an image forming apparatus 10 and a paper sheet feeder 20 as illustrated in FIG. 1. The image forming system is connected to a terminal apparatus 40 via a network 30. The terminal apparatus 40 generates print data and transmits the print data to the image forming apparatus 10 via the network 30. The image forming apparatus 10 receives the print data from the terminal apparatus 40 and outputs an image responsive to the print data on a paper sheet supplied from the paper sheet feeder 20.

The paper sheet feeder 20 of the exemplary embodiment has a long tray and may feed long sheets longer than standard sheets. By using the long tray, long paper sheets, for example, as long as 1200 mm, may be stacked.

Figure 2:
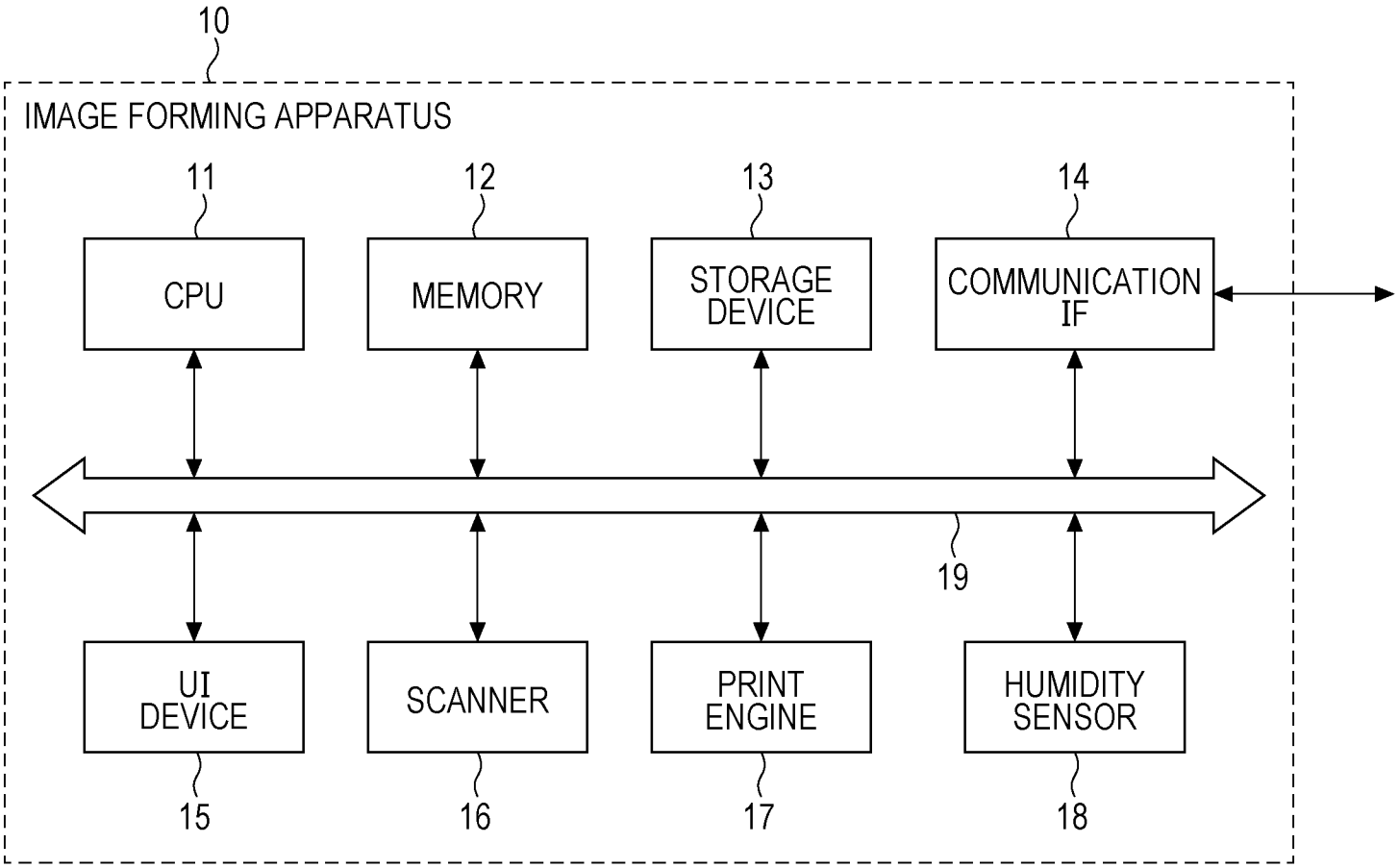
FIG. 2 is a block diagram illustrating a hardware configuration of the image forming apparatus of the exemplary embodiment of the present disclosure.

FIG. 2 illustrates the hardware configuration of the image forming apparatus 10 of the image forming system of the exemplary embodiment.

Referring to FIG. 2, the image forming apparatus 10 includes a central processing unit (CPU) 11, memory 12, storage device 13, such as a hard disk, communication interface (IF) 14, user interface (UI) device 15, scanner 16, print engine 17, and humidity sensor 18. The communication IF 14 transmits or receives data to or from an external apparatus via the network 30. The UI device 15 includes a touch panel or a liquid-crystal display and a keyboard. These elements are connected to each other via a control bus 19.

The print engine 17 prints an image on a recording medium, such a paper sheet, through charging, exposure, development, transfer and fixing operations.

The CPU 11 is a processor that controls the image forming apparatus 10 and performs a specific process in accordance with a control program stored on the memory 12 or the storage device 13. According to the exemplary embodiment, the CPU 11 reads and executes the control program from the memory 12 or the storage device 13. The control program may be supplied to the CPU 11 in a stored form on a storage medium, such as a compact disc read-only memory (CD-ROM).

Figure 3:
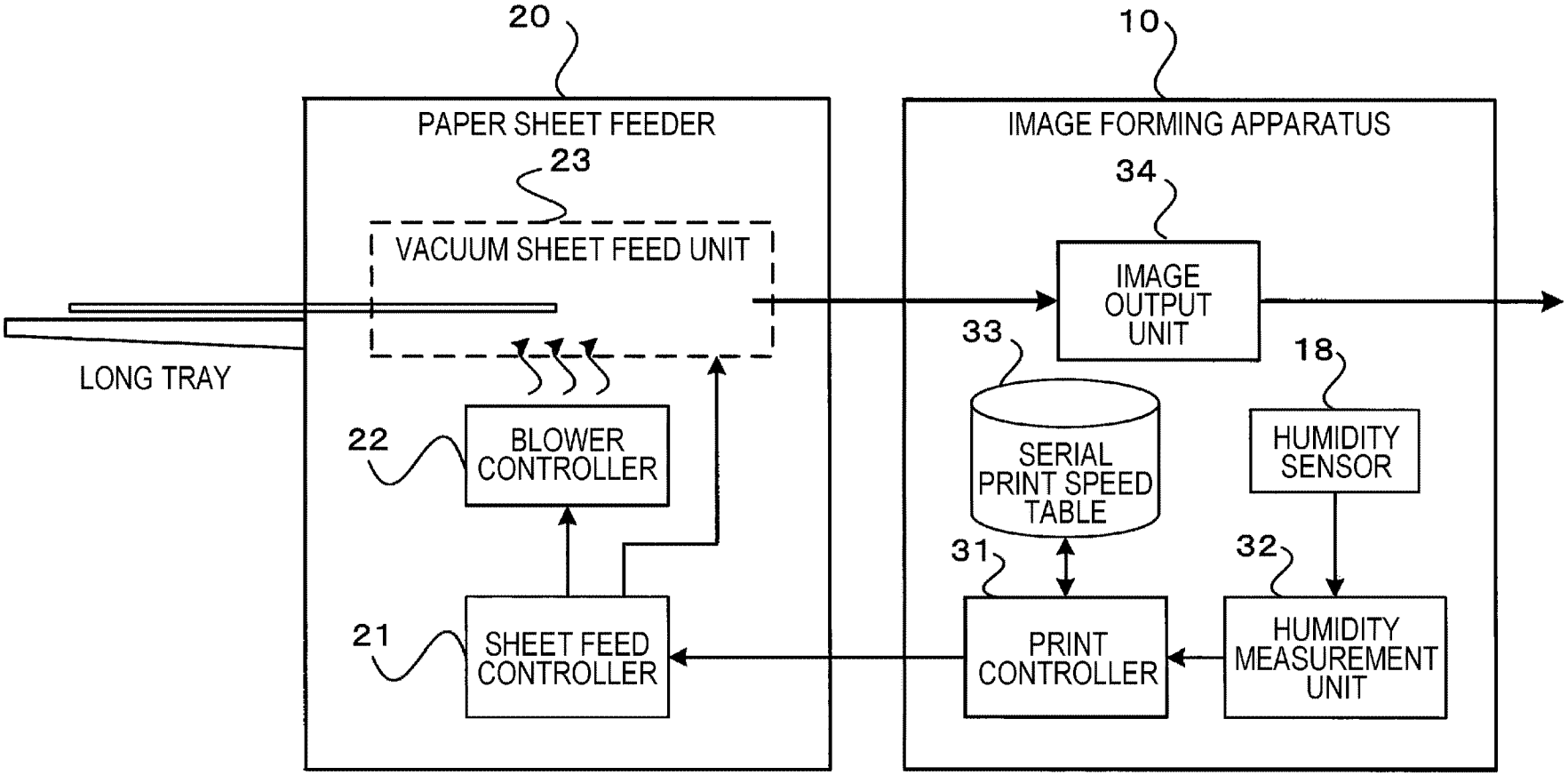
FIG. 3 is a block diagram illustrating a functional configuration of the image forming apparatus and a paper sheet feeder in accordance with the exemplary embodiment of the present disclosure.

FIG. 3 is a block diagram illustrating a function and configuration of the image forming apparatus 10 and the paper sheet feeder 20 implemented when the control program is executed.

The paper sheet feeder 20 of the exemplary embodiment includes a sheet feed controller 21, blower controller 22, and vacuum sheet feed unit 23 as illustrated in FIG. 3.

To separate a paper sheet from other paper sheets stacked in a sheet tray and feed the paper sheet in the paper sheet feeder 20, a blower sends air to the paper sheets to reduce stickiness. Under this condition, a separation operation to separate one sheet from other sheets is performed by sucking up and picking up the sheet.

The sheet feed controller 21 performs control to feed the sheets one by one to the image forming apparatus 10 by controlling the vacuum sheet feed unit 23 at the feed timing instructed by the image forming apparatus 10.

The blower controller 22, under the control of the sheet feed controller 21, controls air blowing to the vacuum sheet feed unit 23.

The paper sheet feeder 20 of the exemplary embodiment uses a feed method called vacuum sheet feed to feed to the image forming apparatus 10 the sheets stacked in a paper sheet tray serving as a paper sheet holder. In the vacuum sheet feed, a single sheet at the top of a stack of sheets is sucked up and fed.

When the vacuum sheet feed is performed, the blowing of airflow is impinged on the front or side of a sheet stack to control overlapping sheet feed in which multiple sheets are fed in an overlapped state. A sheet of the sheet stack is sucked up while being lifted for separation.

Figure 4:
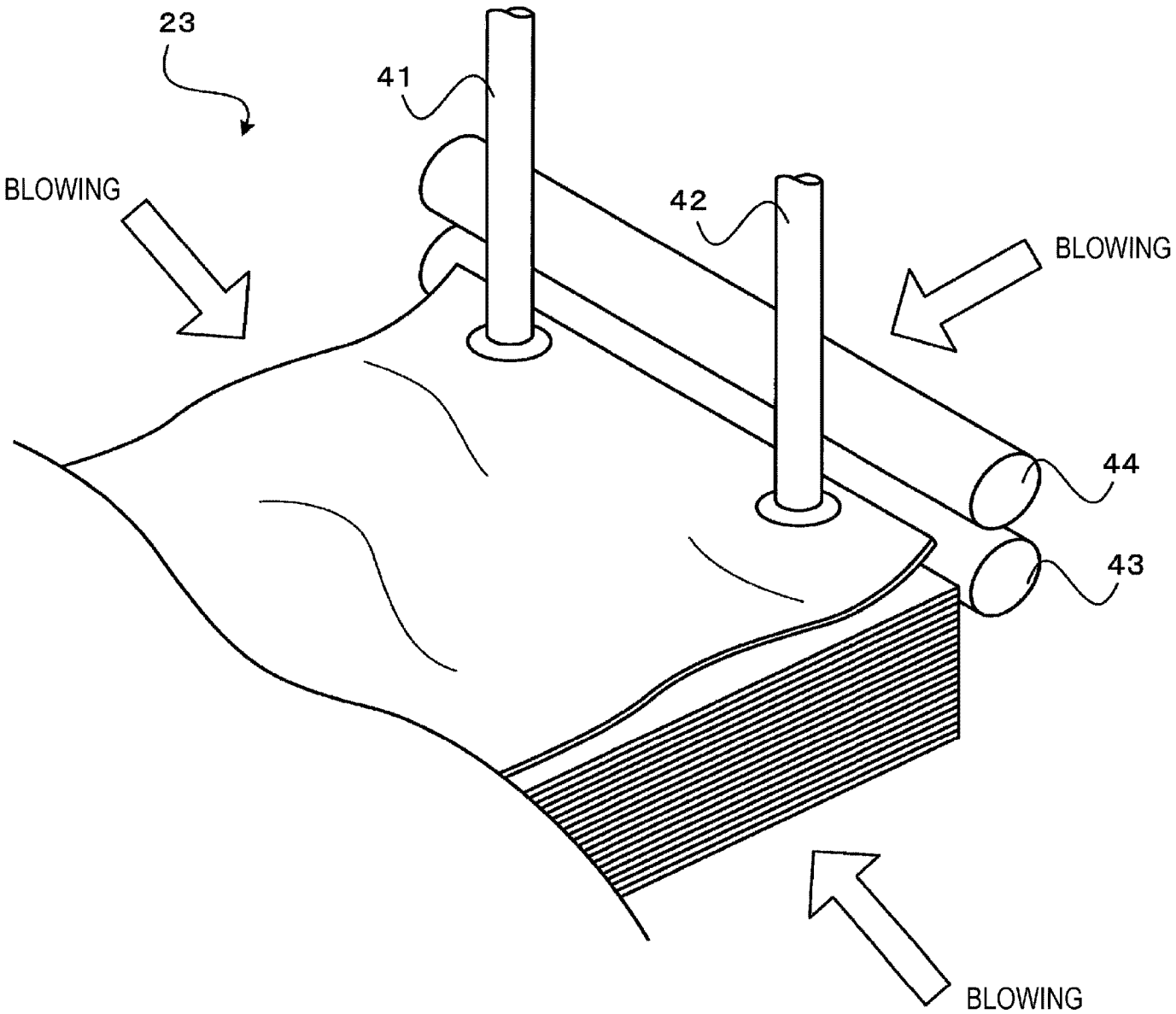
FIG. 4 illustrates vacuum sheet feeding performed by a vacuum sheet feeding unit.

FIG. 4 illustrates the vacuum sheet feed performed by the vacuum sheet feed unit 23 in paper sheet handling.

Referring to FIG. 4, the top sheet of the sheet stack is lifted by blowing air to the leading side and the two lateral sides of the sheet stack. Two sucking sections 41 and 42 are lowered from above the sheet stack and sucks the top sheet with negative pressure. The sucked sheet is moved to transport rollers 43 and 44.

In comparison with the ordinary sheet feed method, the vacuum sheet feed may reduce the possibility of overlapping sheet feed in which multiple sheets overlapped on each other are together fed. Under a higher humidity environment, sheets are more likely to stick to each other and the possibility of the overlapping sheet feed is higher. In particular, when the long sheets having a longer paper sheet length are used or when sheets having a paper quality more easily affected by a higher humidity environment are used, the possibility of the overlapping sheet feed becomes higher.

The image forming apparatus 10 of the exemplary embodiment performs the process described below and thus reduces the possibility of the overlapping sheet feed by lengthening a separation operation time to separate one sheet from the other sheets stacked in a paper sheet holder.

Referring to FIG. 3, the image forming apparatus 10 of the exemplary embodiment includes a humidity sensor 18, print controller 31, humidity measurement unit 32, serial print speed table 33, and image output unit 34.

The humidity sensor 18 detects humidity of the surrounding environment.

The humidity measurement unit 32 measures humidity in the image forming apparatus 10 at the start of a print job using the humidity sensor 18.

The image output unit 34 under the control of the print controller 31 forms an image on a paper sheet fed by the paper sheet feeder 20.

The serial print speed table 33 stores a table that lists a serial print speed set in response to a paper sheet length, paper quality, and paper weight per unit area of each paper sheet and an indication whether a current environment is a higher humidity environment.

The higher humidity environment refers to an environment at a humidity of 60% or higher and a lower humidity environment refers to an environment at a humidity lower than 60%. The paper weight per unit area represents the paper weight per area of 1 $m^2$ and a larger paper weight per unit means a thicker paper sheet.

FIGS. 5 and 6 illustrate examples of the serial print speed table stored in the serial print speed table 33.

FIG. 5 illustrates the serial print speed table in the lower humidity environment.

The serial print speed table is represented by the number of pages printed per minute when the print job of multiple pages is performed. For example, a serial print speed of 40 pages per minute (ppm) indicates a print speed at which 40 pages are printed per minute.

In the serial print speed table in FIG. 5, the serial print speed is set on each of parameters of the paper sheet including the paper quality, paper sheet length, and paper weight per unit area.

Some paper sheets have a paper quality that tends to suffer from the overlapping sheet feed under the higher humidity environment and other paper sheets have a paper quality that does not suffer so much from the overlapping sheet feed even under the higher humidity environment.

The paper sheets having a paper quality that tends to suffer from the overlapping sheet feed under the higher humidity environment include matte coated paper, coated paper, label paper, tack paper, cast paper, film paper, embossed paper, index paper, overhead projector (OHP) paper, and transfer paper. The paper sheets having a paper quality that does not suffer so much from the overlapping sheet feed even under the higher humidity environment include plain paper.

If the serial print speed is 40 ppm, a sheet feeding time interval from the feeding of a page for printing to the feeding of the next page for printing is 1.5 seconds (60 seconds/40 sheets).

In the lower humidity environment having a humidity lower than 60% measured by the humidity measurement unit 32, the print controller 31 determines the serial print speed by referring the serial print speed table in FIG. 5 and instructs the sheet feed controller 21 in the paper sheet feeder 20 to feed the sheets at the sheet feed timing responsive to the determined serial print speed.

For example, a print job in the lower humidity environment for the paper sheet having a quality of coated paper, a paper weight per unit area of 300 g/$m^2$ and a sheet length of 1200 mm may now be performed. The print controller 31 determines a serial print speed of 5 ppm by referring to the serial print speed table in FIG. 5. Specifically, the print controller 31 instructs the sheet feed controller 21 to feed the sheets at the sheet feeding time intervals of 12 seconds (60 seconds/5 sheets).

If the print job starts in the higher humidity environment having a humidity of 60% or more, the print controller 31 determines the serial print speed by referring to the serial print speed table in FIG. 6.

FIG. 6 illustrates an example of the serial print speed table in the higher humidity environment. Like the serial print speed table in the lower humidity environment in FIG. 5, the serial print speed table is set for each of the parameters of the sheets including the sheet lengths and the paper weight per unit area. If the paper sheets are plain, the possibility of the overlapping sheet feed occurring in the higher humidity environment is not so high. In the serial print speed table in FIG. 6, the serial print speed table is not set for the sheets having a plain sheet quality.

The print job in the higher humidity environment for the long paper sheet having a quality of coated paper, a paper weight per unit area of 300 g/m$^2$ and a sheet length of 1200 mm may now be performed. The print controller 31 determines a serial print speed of 3 ppm by referring to the serial print speed table in FIG. 6. Specifically, the print controller 31 instructs the sheet feed controller 21 to feed the sheets at the sheet feeding time intervals of 20 seconds (60 seconds/3 sheets).

The serial print speed is set to be slower as more conditions for the possibility of the overlapping sheet feed are satisfied. The conditions may include the higher humidity environment, longer sheet length, heavier paper weight per unit area, and paper quality that creates the overlapping sheet feed more. The reason why the serial print speed is set to be slower as more conditions are satisfied is described below.

As the sheet feeding time interval is longer, the separation operation time to separate one sheet from other sheets by using airflow in the vacuum sheet feed unit 23 in the paper sheet feeder 20 becomes longer. Also, as the separation operation time is longer, time throughout which the sheets are impinged by the airflow becomes longer. As a result, the possibility that one sheet is separated from the stack sheet is increased.

If the humidity detected by the humidity sensor 18 is equal to or higher than a preset value, the print controller 31 performs control to cause the separation operation time to be longer by lengthening the sheet feeding interval in the paper feeding.

The humidity detected by the humidity sensor 18 may be a preset value, for example, 80% or higher when the sheets stacked in the paper sheet tray in the paper sheet feeder 20 is fed to the image output unit 34. In such a case, the print controller 31 performs control such that the separation operation time to separate a sheet from the other sheets stacked in the paper sheet tray is longer than when the detected humidity is lower than the preset value.

The print controller 31 performs control such that the sheet feeding time interval in the sheet feeding is longer as the sheet length of the sheets in the transport direction thereof is longer.

The print controller 31 also performs control such that the sheet feeding time interval in the sheet feeding is longer as the paper weight of the sheet per unit area is heavier.

The print controller 31 further performs control such that the sheet feeding time interval in the sheet feeding is longer if the paper quality of the sheet to be fed is more subject to the overlapping sheet feed.

The process of the image forming apparatus 10 and paper sheet feeder 20 of the exemplary embodiment is described with reference to FIG. 7.

Figure 7:
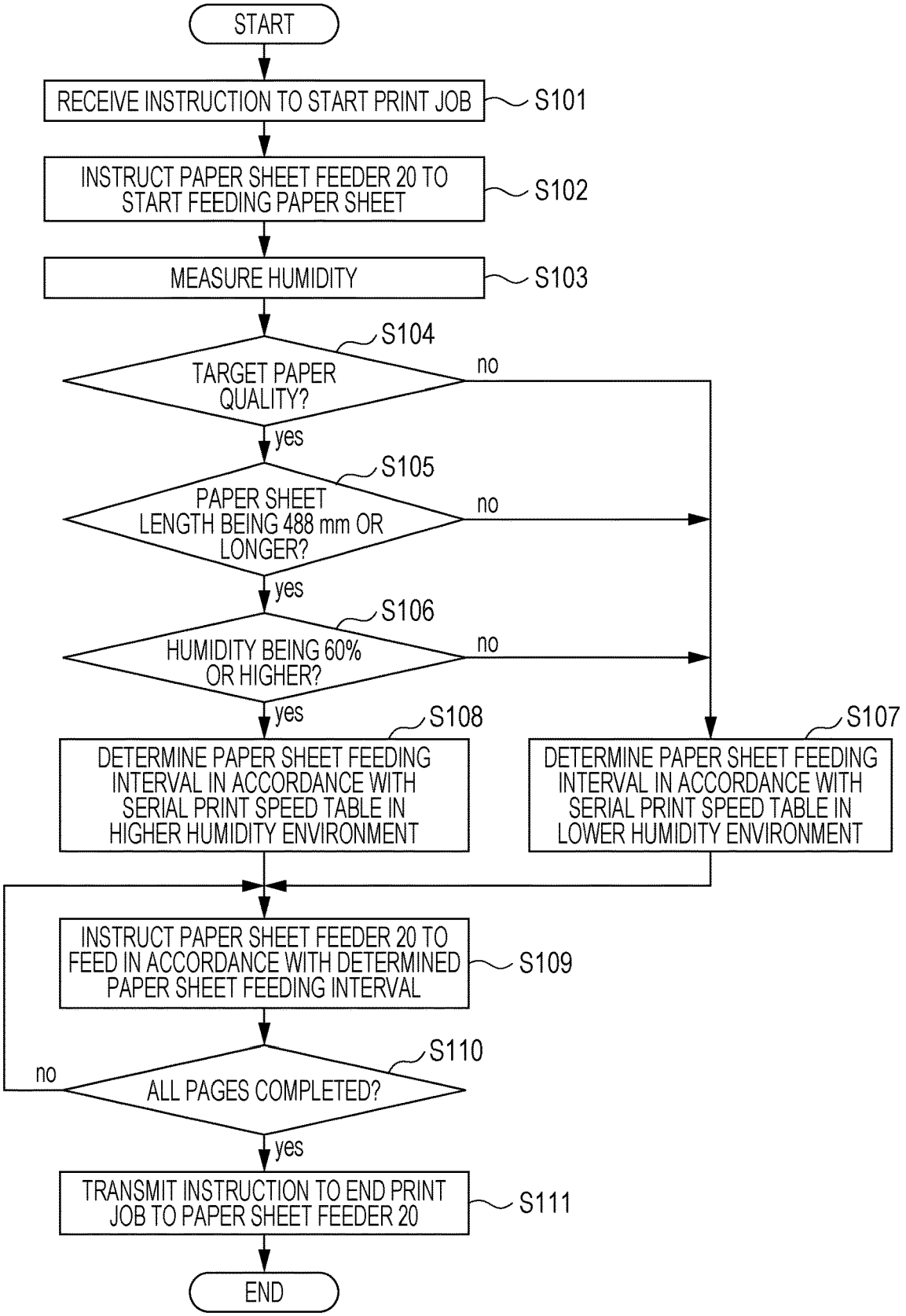
FIG. 7 is a flowchart illustrating a process performed when sheet feeding time intervals are determined in a print job that the image forming apparatus performs in response to the reception of an instruction to start the print job.

FIG. 7 is a flowchart illustrating the process that determines the sheet feeding time interval when the image forming apparatus 10 starts a print job in response to the reception of a start instruction of the print job.

In step S101, the print controller 31 receives the start instruction of the print job responsive to a user operation. In step S102, the print controller 31 notifies the paper sheet feeder 20 of job information on the print job including information on the sheets to be used and also transmits a sheet feeding start instruction to the paper sheet feeder 20.

In step S103, the humidity measurement unit 32 measures humidity using the humidity sensor 18 and notifies the print controller 31 of the measured humidity.

In step S104, the print controller 31 determines whether the sheets to be used in the print job have a target paper quality of a sheet, such as coated paper, which is more likely to be overlapped-fed under the higher humidity environment.

In step S105, the print controller 31 determines whether the sheet length of the sheets to be used in the print job is equal to or longer than 488 mm.

In step S106, the print controller 31 determines the humidity measured by the humidity measurement unit 32 is equal to or higher than 60%.

If any of the conditions specified in steps S104 through S106 is not satisfied, the print controller 31 determines in step S107 the sheet feeding time interval in accordance with the serial print speed table for the lower humidity environment in FIG. 5.

If all the conditions specified in steps S104 through S106 are satisfied, the print controller 31 determines in step S108 the sheet feeding time interval in accordance with the serial print speed table for the higher humidity environment in FIG. 6.

In step S109, the print controller 31 provides a sheet feeding instruction to the sheet feed controller 21 in the paper sheet feeder 20 on a per page print operation in response to the determined sheet feeding time interval.

If the print controller 31 determines in step S110 that the print operation for all the pages is complete, the print controller 31 ends the process after transmitting an end instruction of the print job to the paper sheet feeder 20 in step S111.

Figure 8:
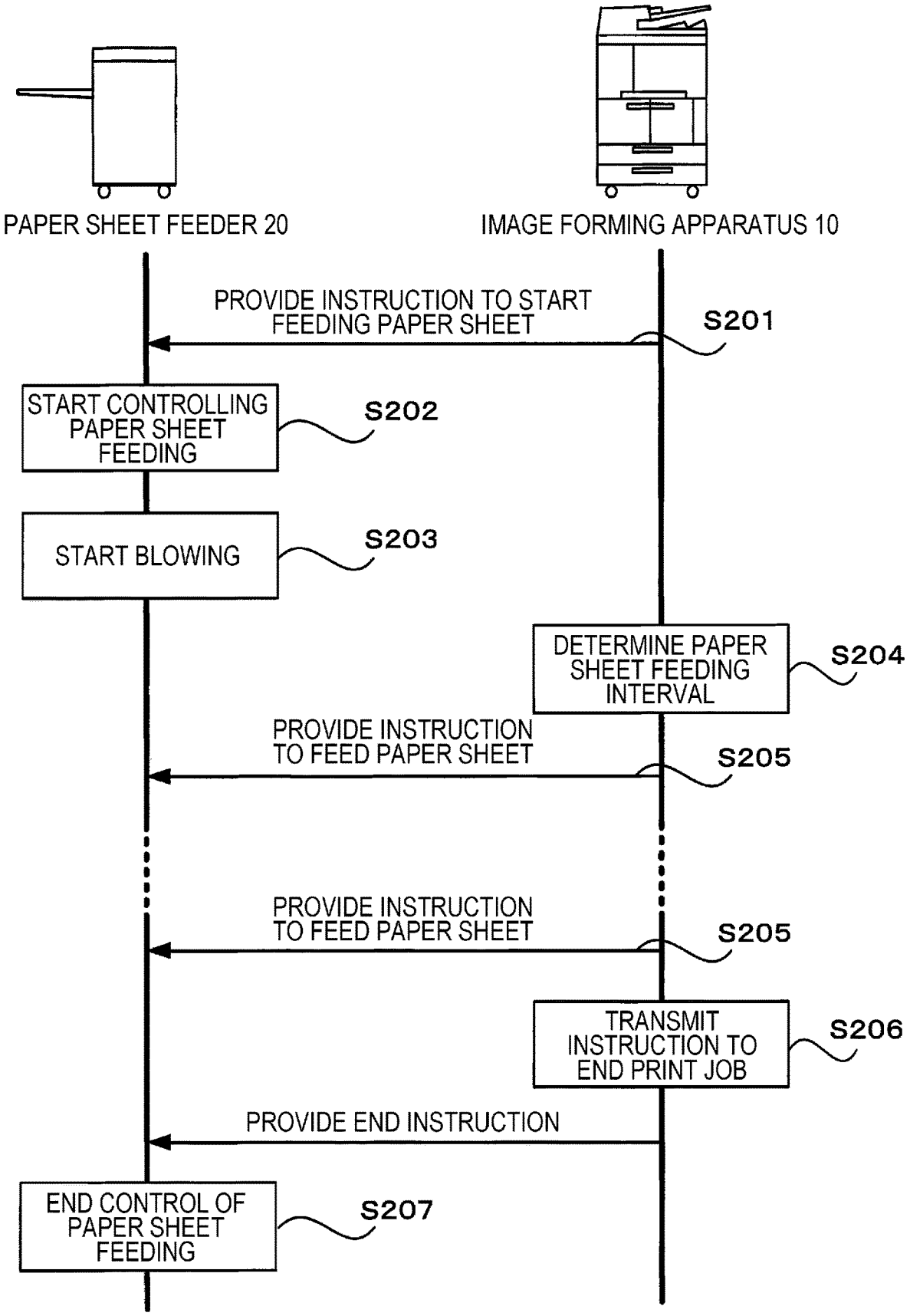
FIG. 8 is a sequence chart illustrating an exchange of information performed between the image forming apparatus and the paper sheet feeder.

The information exchange performed between the image forming apparatus 10 and the paper sheet feeder 20 is described with reference to a sequence chart in FIG. 8.

To start the print job, the image forming apparatus 10 transmits a sheet feeding start instruction to the paper sheet feeder 20 in step S201.

The paper sheet feeder 20 starts sheet feeding control in step S202 and starts blowing air in step S203.

In step S204, the image forming apparatus 10 determines the sheet feeding time interval in accordance with the method described with reference to FIG. 7. On a per page print operation, the image forming apparatus 10 provides in step S205 the sheet feeding instruction to the paper sheet feeder 20.

When the print operation for all the pages is complete, the image forming apparatus 10 transmits in step S206 an end instruction to end the print job.

The paper sheet feeder 20 ends the sheet feed control in step S207.

As described above, the print controller 31 in the image forming apparatus 10 instructs the sheet feed controller 21 in the paper sheet feeder 20 to perform sheet feeding at a constant sheet feeding time interval responsive to the serial print speed that is obtained by referring to the serial print speed table. An overlapping sheet feed detector detecting whether overlapping sheet feed has occurred on the sheets fed from the paper sheet feeder 20 may be mounted on the image forming apparatus 10 and sheet overlapping may be detected even when the sheets are fed under the higher humidity environment at the sheet feeding timing that is determined by referring to the serial print speed table. In such a case, the print controller 31 may dynamically switch the sheet feeding time intervals by lengthening the sheet feeding time interval by delaying the sheet feeding timing.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

Modifications

According to the exemplary embodiments, the image forming apparatus 10 and the paper sheet feeder 20 are separate apparatuses. The present disclosure is not limited to this configuration. The present disclosure may be related to a single image forming apparatus that implements the function of the image forming apparatus 10 and the function of the paper sheet feeder 20.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a memory; and a processor configured to when humidity detected by a humidity sensor is equal to or above a preset value with paper sheets stacked in a paper sheet holder being fed to an image forming unit, perform control to set a separation operation time used to separate in a separation operation a single paper sheet from a plurality of paper sheets stacked in the paper sheet holder to be longer than the separation operation time used when the detected humidity is lower than the preset value.

2. The image forming apparatus according to claim 1, wherein when the single sheet is to be separated from the sheets stacked in the paper sheet holder in the separation operation, the single paper sheet is separated from the paper sheets by sucking and picking up the single paper sheet in a blowing state in which a blower blows air to the sheets, and wherein the processor is configured to, when the humidity detected by the humidity sensor is equal to or above the preset value, perform control to lengthen the separation operation time by setting a sheet feeding time interval to be longer in paper feeding.

3. The image forming apparatus according to claim 2, wherein the processor is configured to perform control to set the sheet feeding time interval to be longer in the paper feeding as a length of the fed sheets in a transport direction of the sheets is longer.

4. The image forming apparatus according to claim 2, wherein the processor is configured to perform control to set the sheet feeding time interval to be longer in the paper feeding as a weight of the fed sheet per unit area is heavier.

5. The image forming apparatus according to claim 2, wherein the processor is configured to perform control to set the sheet feeding time interval to be longer in the paper feeding if the sheet to be fed has a paper quality that is more subject to overlapping sheet feed.

6. A non-transitory computer readable medium storing a program causing a computer to execute a process for forming an image, the process comprising:

when humidity detected by a humidity sensor is equal to or above a preset value with paper sheets stacked in a paper sheet holder being fed to an image forming unit, performing control to set a separation operation time used to separate in a separation operation a single paper sheet from a plurality of paper sheets stacked in the paper sheet holder to be longer than the separation operation time used when the detected humidity is lower than the preset value.

7. An image forming apparatus comprising:

means for storing data; and means for, when humidity detected by a humidity sensor is equal to or above a preset value with paper sheets stacked in a paper sheet holder being fed to an image forming unit, performing control to set a separation operation time used to separate in a separation operation a single paper sheet from a plurality of paper sheets stacked in the paper sheet holder to be longer than the separation operation time used when the detected humidity is lower than the preset value.

* * * * *